US006827181B2

(12) United States Patent
Austin et al.

(10) Patent No.: US 6,827,181 B2
(45) Date of Patent: Dec. 7, 2004

(54) LOW LEVEL ADJUSTABLE SCAFFOLD WITH WORKBENCH

(76) Inventors: Jack S. Austin, 89 Briarwood Ave., Southbridge, MA (US) 01550; Paul N. Remillard, 301 Dresser Hill Rd., Southbridge, MA (US) 01550

( * ) Notice: Subject to any disclaimer, the term of this patent is extended or adjusted under 35 U.S.C. 154(b) by 0 days.

(21) Appl. No.: 10/607,248

(22) Filed: Jun. 25, 2003

(65) Prior Publication Data

US 2004/0016600 A1 Jan. 29, 2004

Related U.S. Application Data

(60) Provisional application No. 60/392,079, filed on Jun. 27, 2002.

(51) Int. Cl.[7] ..... E04G 1/00

(52) U.S. Cl. ..... 182/186.6; 182/181.1; 182/182.1; 182/225; 182/150

(58) Field of Search ..... 182/186.6, 181.1, 182/182.1, 150, 225, 132, 155, 82, 227, 131, 224, 226

(56) References Cited

U.S. PATENT DOCUMENTS

| | | | | | |
|---|---|---|---|---|---|
| 902,949 | A | * | 11/1908 | Dibler | 182/146 |
| 1,659,113 | A | * | 2/1928 | Marks | 182/182.3 |
| 1,714,044 | A | * | 5/1929 | Pedersen | 182/113 |
| 2,257,876 | A | * | 10/1941 | Berchem et al. | 182/153 |
| 2,376,787 | A | * | 5/1945 | Larson | 182/182.3 |
| 2,398,604 | A | * | 4/1946 | Thorne | 182/225 |
| 2,549,212 | A | * | 4/1951 | Lane | 182/182.1 |
| 2,820,678 | A | * | 1/1958 | Huber | 52/632 |
| 2,900,870 | A | * | 8/1959 | Jackson | 359/451 |
| 3,071,204 | A | * | 1/1963 | Piltingsrud | 182/27 |
| 3,082,843 | A | * | 3/1963 | Leonard | 182/82 |
| 3,245,495 | A | * | 4/1966 | Wells, Jr. | 182/152 |
| 3,794,183 | A | * | 2/1974 | Colbridge | 211/208 |
| 4,375,245 | A | * | 3/1983 | Schill | 182/155 |
| 4,632,344 | A | * | 12/1986 | Lang et al. | 248/165 |
| 4,782,917 | A | * | 11/1988 | Schulz | 182/182.2 |
| 4,877,109 | A | * | 10/1989 | Welch et al. | 182/182.4 |
| 5,865,269 | A | * | 2/1999 | Eskesen | 182/182.2 |
| 5,954,156 | A | * | 9/1999 | Cooke | 182/153 |
| 6,070,696 | A | * | 6/2000 | Chubb et al. | 182/227 |
| 6,340,070 | B1 | * | 1/2002 | Villareal et al. | 182/82 |
| 6,419,048 | B1 | * | 7/2002 | Robinson et al. | 182/182.1 |

FOREIGN PATENT DOCUMENTS

| | | | | |
|---|---|---|---|---|
| GB | 2378978 | * | 7/2002 | 182/186.6 X |

* cited by examiner

*Primary Examiner*—Bruce A. Lev
(74) *Attorney, Agent, or Firm*—Robert M. Downey, PA

(57) ABSTRACT

A collapsible and adjustable scaffold unit includes a base frame structure and an upper frame structure. Leg members on the base frame structure are independently adjustable in length and include pivoting feet to compensate for grade change and uneven terrain. The upper frame structure includes a vertical post which removably attaches to the base frame structure to accommodate adjustably positionable brace arms. The brace arms support planks spanning between two or more of the scaffold units to provide an uninterrupted walkway and a continuous workbench above the walkway. Adjusted movement of the brace arms along the vertical post, throughout a range of locked positions, allows the height of the walkway and workbench to be selectively varied according to the needs of the user.

9 Claims, 5 Drawing Sheets

LOW LEVEL ADJUSTABLE SCAFFOLD WITH WORKBENCH

This application claims benefit of application Ser. No. 60/392,079 filed Jun. 27, 2002.

BACKGROUND OF THE INVENTION

1. Field of the Invention

This invention relates to scaffolds used in general construction and repair of commercial and residential structures and, more particularly, to a collapsible and adjustable scaffold assembly for supporting one or more workers, as well as construction materials and tools at low level heights of between approximately two feet and approximately six feet above the ground, with height adjustments at two-inch increments. The scaffold assembly collapses for storage and easy transport in and out of homes and buildings.

2. Discussion of the Related Art

Scaffold structures of various types are well known and used in many aspects of construction and repair of commercial and residential buildings. The most common type of scaffold structure incorporates the use of steel or aluminum tubular frame sections which interconnect to form an erected assembly of horizontal and vertical bars that function both as a ladder and a means to support planks to form platforms at one or more levels above the ground. Typically this type of scaffold structure is used when it is necessary to perform various tasks at considerable heights which cannot be done safely with the use of a ladder. However, because this type of scaffold structure can be expensive and requires considerable time for assembly and disassembly, it is generally only practical for use on large construction and repair projects which reach considerable heights, generally above twelve feet.

Other scaffold structures include adjustable scaffolds which have been developed to provide for ease of assembly and quick collapse. Examples of these types of structures can be seen in U.S. Pat. Nos. 1,659,113 and 2,257,876. Other, more elaborate scaffold structures have been developed for use in working on the exterior walls of multi-story buildings. An example of this type of structure is seen in U.S. Pat. No. 6,340,070.

More pertinent to the present invention are portable, and easily collapsible scaffold structures which incorporate the use of a sawhorse frame structure as a base. Examples of sawhorse-type structures are seen in U.S. Pat. Nos. 2,376,787; 4,375,245; 4,877,109; and 4,782,917.

Despite the numerous variations in design and structure of scaffold assemblies proposed in the past, there remains a need for a collapsible and adjustable low level scaffold assembly which is easily assembled, collapsed, stored and transported and which provides an unobstructed walkway and a raised, continuous workbench alongside the walkway, for supporting one or more workers, as well as tools and building materials, at adjusted heights ranging between approximately two feet and six feet above the ground.

SUMMARY OF THE INVENTION

The present invention is directed to a collapsible and adjustable scaffold unit having a base frame structure and an upper frame structure which removably attaches to the base frame structure. The base frame structure generally resembles a sawhorse and includes pairs of downwardly and outwardly extending leg members at each end. Lower telescoping sections of each leg member extend and lock into position at one-inch increments to provide independent adjustment of the length of each leg member. The bottom ends of the telescoping sections are provided with ground engaging pivoting feet. The independently adjustable leg members and pivoting feet compensate for grade change and uneven terrain.

The upper frame structure of the scaffold unit includes a vertical post which removably attaches to the base and extends upwardly therefrom. A first brace arm is slidably received on the vertical post and is moveable throughout a range of adjusted height positions. An alloy safety pin is used to selectively lock the first brace arm at any of the adjusted height positions. A second brace arm is attachable to the first brace arm and extends upwardly and outwardly from the vertical post, above and opposite to the first brace arm. A staging plank spanning between two or more of the scaffold units is supported on the first brace arm of each unit to provide an unobstructed walkway. Another plank is supported on the second brace arm of each of the spaced-apart scaffold units to provide a continuous workbench above the walkway. In the preferred embodiment, the workbench is supported at a height of approximately three feet above the walkway and is offset along one side of the scaffold assembly so that it is convenient to workers standing on the walkway without interfering with passage along the walkway. The workbench provides a clear, unobstructed surface for placement of tools and building materials and can support a considerable load, thereby allowing workers to continue a task without having to repeatedly climb off and onto the scaffold to replenish materials or exchange tools. Movement of the first brace arm throughout the range of locked positions on the vertical post of each scaffold unit allows the height of the walkway and workbench to be selectively adjusted according to the needs of the user(s). In the preferred embodiment, the walkway is adjustable from a height of approximately two feet above the ground to a height of approximately six feet above the ground, while the workbench is maintained at a height of approximately three feet above the walkway.

OBJECTS AND ADVANTAGES OF THE INVENTION

With the foregoing in mind, it is a primary object of the present invention to provide a collapsible and adjustable scaffold assembly which is easy to transport, assemble and dissemble and which provides a continuous, unobstructed walkway and a continuous workbench for supporting construction materials and tools in convenient proximity to one or more workers standing on the walkway.

It is a further object of the present invention to provide a collapsible and adjustable scaffold assembly which is easily assembled on uneven terrain to provide a stable uninterrupted walkway and continuous workbench at selectively adjusted heights above the ground.

It is still a further object of the present invention to provide a collapsible and adjustable scaffold assembly which is freestanding and includes independently adjustable legs and swivel feet to compensate for grade change and uneven terrain.

It is still a further object of the present invention to provide a collapsible and adjustable scaffold assembly which includes at least one and preferably two or more scaffold units each having a base frame structure and an upper frame structure, and wherein the scaffold assembly is easily transported, assembled and disassembled to provide a continuous, uninterrupted walkway at adjusted elevated heights ranging between approximately two feet and six feet above the ground.

It is still a further object of the present invention to provide a collapsible and adjustable scaffold assembly which provides low level staging particularly suited for jobs requiring elevation of workers at heights of between approximately two feet and six feet above the ground.

It is still a further object of the present invention to provide an adjustable scaffold assembly which is completely collapsible and easily transported, and which can be stored in an area measuring approximately 24 inches by 24 inches by 44 inches.

These and other objects and advantages of the present invention are more readily apparent with reference to the following detailed description and accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to the several views of the drawings, the scaffold assembly of the present invention is shown and includes at least one, and preferably two or more scaffold frame units 10 as the principal component of the invention.

As seen throughout the drawings, the scaffold frame unit 10 includes a base frame structure 12 and an upper frame structure 14. Both the base frame structure and the upper frame structure consist primarily of steel or aluminum square tubular sections of various size which are welded as appropriate to form the shown configuration, thereby providing a rigid and sturdy frame structure.

Figure 2:
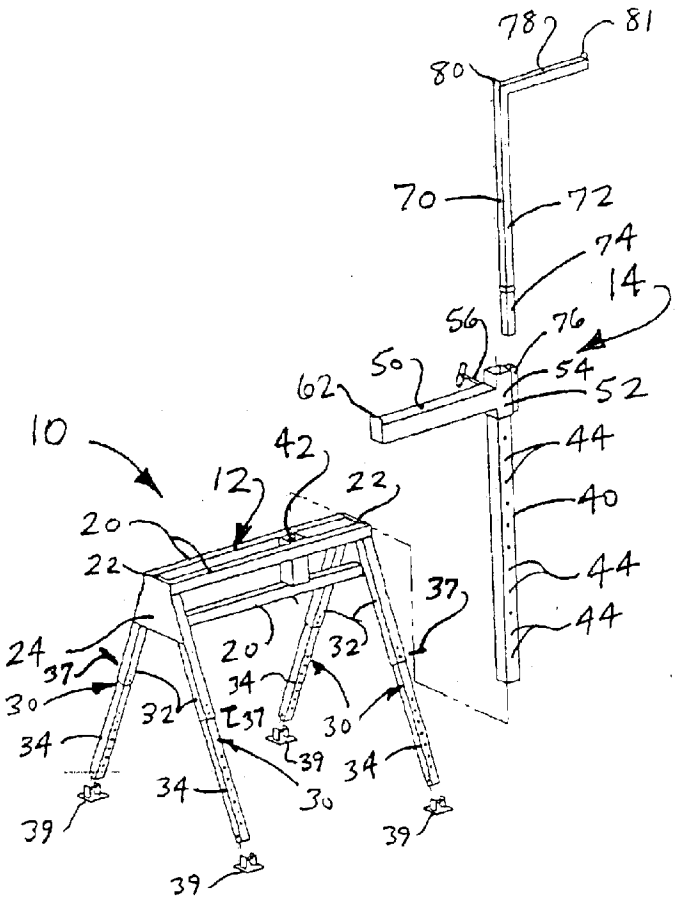
FIG. 2 is a partially exploded view of the scaffold unit of FIG. 1 showing the upper frame structure partially disassembled and separated from the base frame structure.
Figure 1:
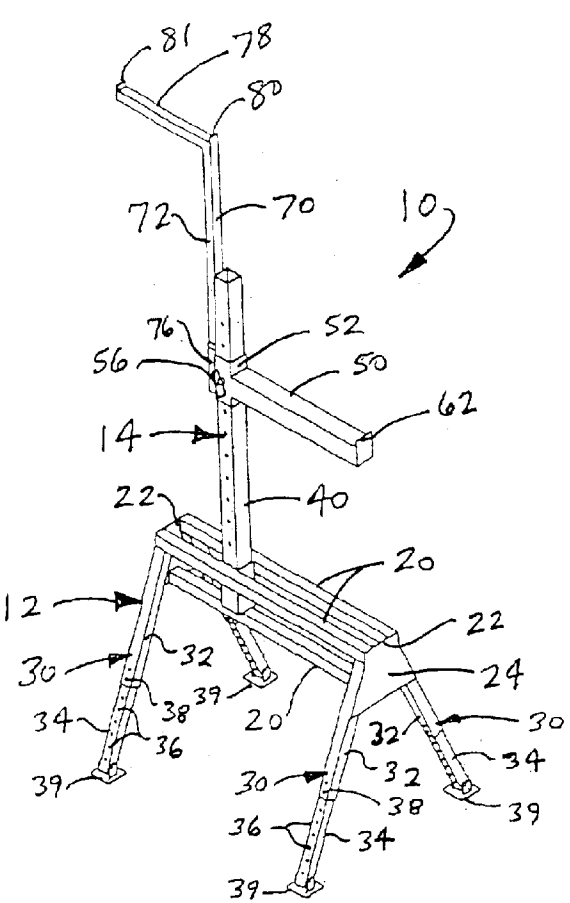
FIG. 1 is a perspective view of the collapsible and adjustable scaffold unit showing the base frame structure and upper frame structure fully assembled.
Figure 3:
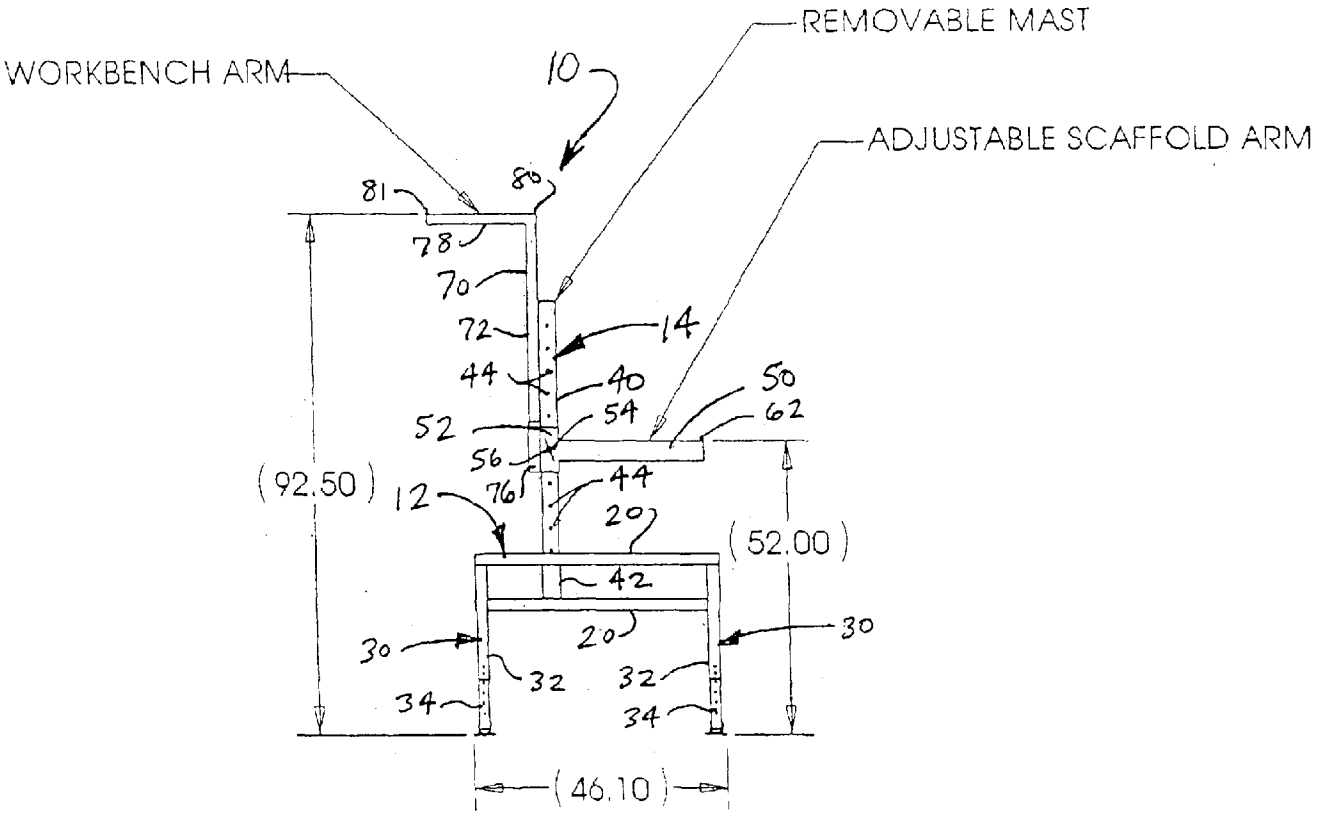
FIG. 3 is a side elevational view of the scaffold unit of FIG. 1.
Figure 5:
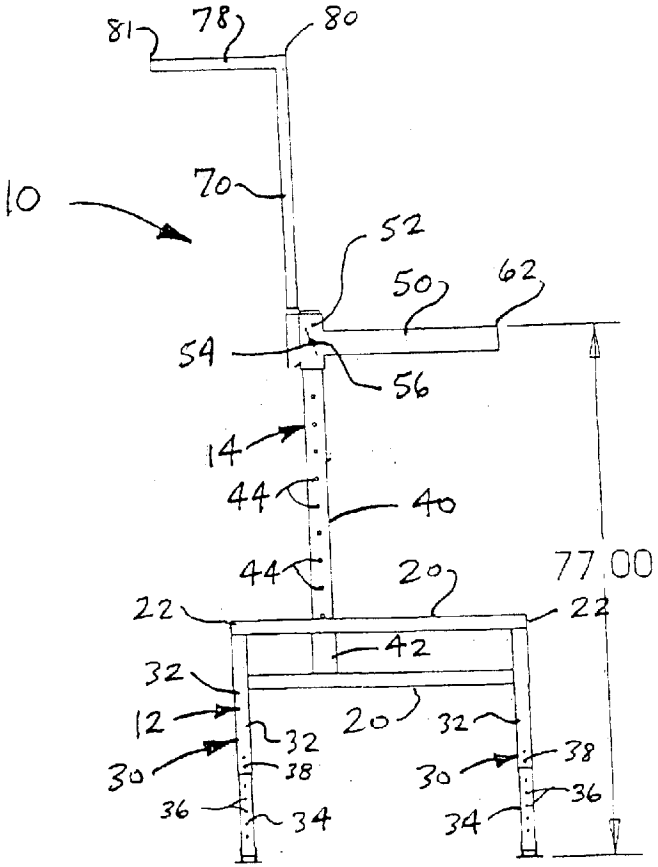
FIG. 5 is a side elevational view of the scaffold unit of FIG. 1 shown with the brace arms adjustably locked at a fully raised position.
Figure 4:
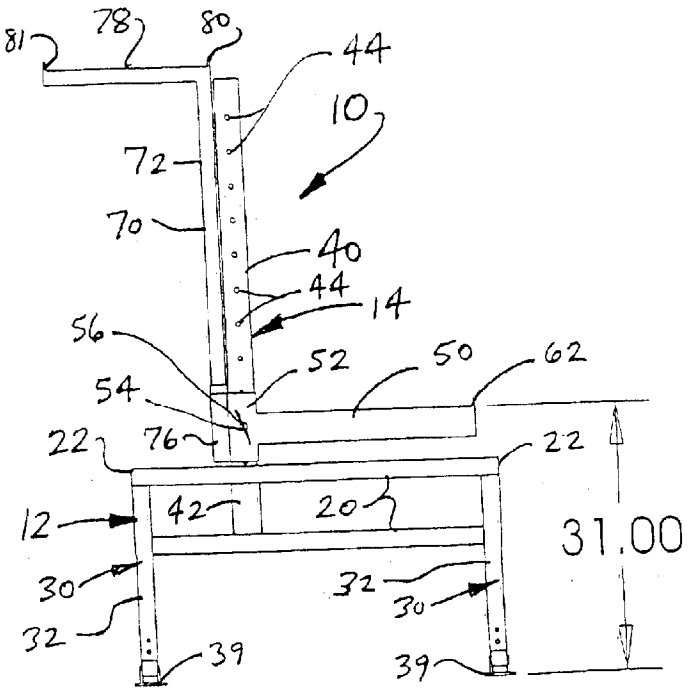
FIG. 4 is a side elevational view of the scaffold unit of FIG. 1 shown with the brace arms of the upper frame structure at a fully lowered position.
Figure 6:
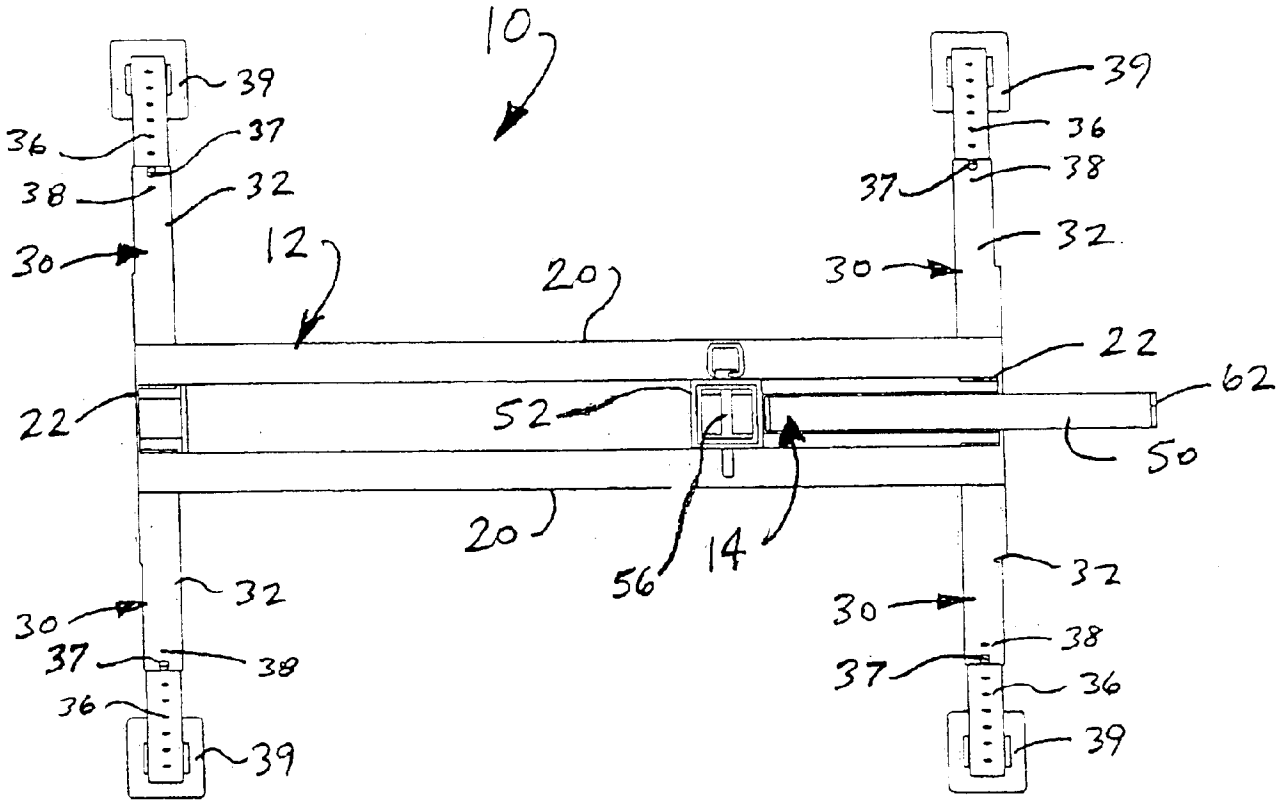
FIG. 6 is a top plan view of the scaffold unit of FIG. 1.

The base frame structure has a generally sawhorse configuration and includes horizontal frame members 20 extending between opposite ends 22. In a preferred embodiment, end plates 24 are used for providing a rigid structure to which the several square tubular sections of the base frame structure can be welded, as best seen in FIGS. 1 and 2. The base frame structure is further provided with leg members 30 for supporting the base on a ground surface. In a preferred embodiment, a pair of leg members extend downwardly and outwardly, at an angle, at each end of the base frame structure to provide greater stability. Each leg member 30 includes an upper fixed section 32 which is welded to the end plate 24 and possibly one or more of the horizontal frame members 20. The leg members 30 each further include a lower section 34 which is slidable within the upper section 32. The lower section 34 is telescopically extendible relative to the upper section 32 to vary the overall length of each leg member 30. Apertures 36 formed through the lower leg sections are arranged at equally spaced increments, preferably one inch apart. As the lower leg section 34 of any of the leg members 30 is telescopically extended or retracted relative the fixed leg section 32, the apertures 36 pass successively in alignment with corresponding apertures 38 formed through the upper fixed leg members 32. When the lower leg section 34 is extended or retracted to the desired, adjusted length, one or more alloy safety pins 37 are inserted through the aligned apertures on the upper and lower leg sections to effectively lock the lower leg section 34 in fixed position at the selected length. The bottom ends of each of the lower leg sections 34 are fitted with pivoting feet 39 for stabilized engagement with the underlying ground surface. The ability to independently adjust the length of each leg member 30, throughout a range of approximately twelve inches, combined with the pivoting feet 39 enables the base frame structure 12 to be set up and stabilized on uneven ground surfaces of varying level and slope.

The upper frame structure 14 is removably attachable to the base frame structure 12, allowing the base frame structure 12 to be used alone or in combination with the assembly of the upper frame structure 14. The upper frame structure 14 includes a vertical post 40 which is received within a square socket 42 welded to the base frame structure 12 to support the vertical post upright, extending vertically above the base frame structure as shown throughout the several views of the drawings.

A first brace arm 50 is adjustably fitted to the vertical post 40 and includes a tubular collar 52 which is slidably received about the vertical post 40 so that the first brace arm 50 extends generally perpendicular to the vertical post and in spaced, parallel relation above the horizontal frame members 20 of the base frame structure 12. The vertical post 40 is provided with a plurality of apertures 44 formed therethrough at equally spaced increments for corresponding alignment with apertures 54 formed through opposite sides of the collar 52 of the first brace arm 50. Upon sliding, vertically adjusted movement of the brace arm relative to the vertical post, the through apertures of the collar successively pass in alignment with the spaced apertures of the vertical posts. When the first brace arm 50 is positioned at the desired adjusted height on the vertical post 40, an alloy safety pin 56 is inserted through the aligned apertures 54, 44 of the square collar and vertical post, respectively, to lock the first brace arm 50 at the selected height.

Figure 7:
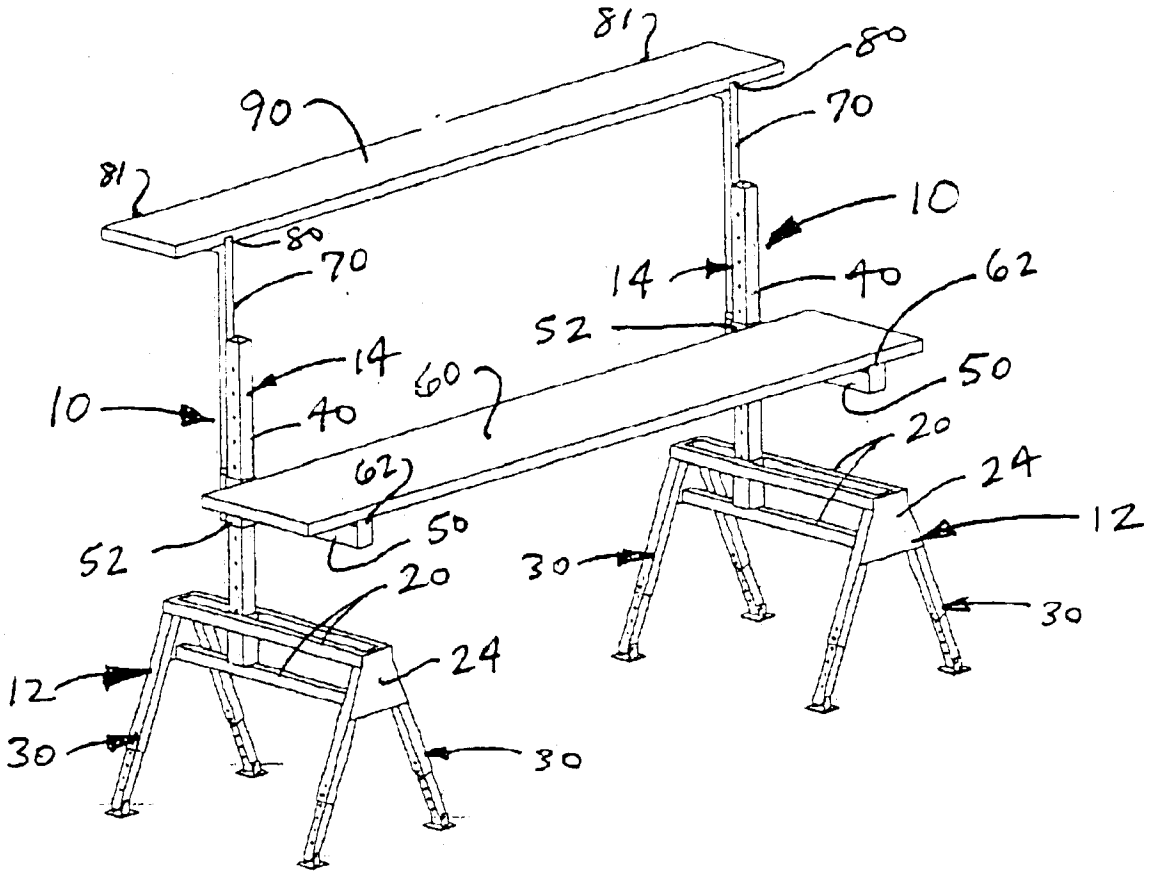
FIG. 7 is a perspective view showing a fully assembled scaffold assembly using two scaffold units of the present invention in spaced relation to support a lower plank providing a continuous, uninterrupted walkway and an upper plank to provide a continuous workbench above the walkway.

The first brace arm 50 is specifically intended to support a staging plank 60. More specifically, in use, two or more scaffold units 10 are positioned in spaced relation, as seen in FIG. 7, and a staging plank 60 is supported on the first brace arms 50 of the two units 10 thereby providing a continuous and uninterrupted walkway spanning between the two units. In a preferred embodiment, the first brace arm 50 is provided with an upwardly directed lip 62 to captivate the staging plank 60 on the top surface of the brace arm 50 of each unit 10 in a manner which prevents the staging plank from slipping off of the outer ends of the first brace arms. In a preferred embodiment, the length of the first brace arm 50, between the square collar 52 and the outer lip 62, is sized to accommodate a 24-inch wide staging plank.

The scaffold assembly of the present invention further provides means for supporting a continuous workbench above the walkway for supporting construction materials and tools in convenient proximity to one or more workers standing on the walkway. In particular, a second brace arm 70 is provided for supporting a plank 90 above the level of the first brace arm and staging plank. As seen throughout the several views of the drawings, the second brace arm 70 includes a vertical extension 72 having a lower end 74 adapted for removable receipt within a socket 76 on the side of the square collar 52, opposite of the first brace arm 50. When received within the socket 76, the second brace arm 70 extends upwardly to a height of approximately three feet above the first brace arm 50. A horizontal extension 78 of the second brace arm extends outwardly, in the opposite direction of the extension of the first brace arm. Upwardly directed lips 80, 81 on the top of the horizontal extension of the second brace arm captivate the workbench plank 90 on the second brace arm, as seen in FIG. 7. Movement of the first brace arm throughout the range of located positions on the vertical post allows the height of both the walkway and the workbench to be selectively adjusted according to the needs of the user.

While the instant invention has been shown and described in accordance with a preferred and practical embodiment thereof, it is recognized that departures from the instant disclosure are contemplated within the spirit and scope of the present invention.

What is claimed is:

1. A scaffold apparatus comprising:

at least one frame unit including a base frame structure and an upper frame structure removably attachable to said base frame structure;

said base frame structure including:

at least one horizontal frame member having opposite ends;

a plurality of leg members extending downwardly and outwardly from said at least one horizontal frame member and each of said plurality of leg members including an upper fixed section and a lower extendible section, said lower section of each of said plurality of leg members terminating at a bottom distal end and said lower section being adjustably extendable and retractable relative to said upper section throughout a range of adjusted positions to selectively vary the length of said leg member;

said upper frame member including:

a vertical post attachable to said base frame structure;

a first brace arm movably received and supported on said vertical post and extending perpendicularly thereto, said first brace arm being selectively movable relative to said vertical post throughout a range of fixed vertically adjusted positions; and a second brace arm movably supported on said vertical post and said second brace arm including a horizontal portion extending generally perpendicular to said vertical post and above and opposite to said first brace arm, and a vertical extension member formed generally perpendicular and integral with said horizontal portion, and said vertical extension member including a lower end zone;

a socket fixed to a side of said tubular collar on said first brace arm, and said socket being structured and disposed for removable supported receipt of said lower end zone of said vertical extension member of said second brace arm, to thereby support said vertical extension member in generally parallel, vertically extending relation to said vertical post of said upper frame structure, and said second brace arm being movable with said first brace arm throughout said range of fixed, vertically adjusted positions; and said first brace arm being structured and disposed for supporting a horizontally extending staging plank, and said horizontal portion of said second brace arm being structured and disposed for supporting a horizontally extending plank at a fixed height above said staging plank.

2. The scaffold apparatus as recited in claim 1 wherein said plurality of leg members include a first pair of said leg members extending downwardly and outwardly from a first one of said opposite ends of said at least one horizontal frame member and a second pair of said leg members extending downwardly and outwardly from a second one of said opposite ends of said at least one horizontal frame member, and thereby defining a sawhorse configuration.

3. The scaffold apparatus as recited in claim 2 wherein said bottom distal ends of said plurality of leg members have pivoting feet structured and disposed for engagement with an underlying ground surface, and said pivoting feet being movable to accommodate for variations in the angle and contour of the underlying ground surface to thereby provide a stabilized seated engagement therewith.

4. The scaffold apparatus as recited in claim 1 wherein said first brace arm includes a tubular collar sized, structured and configured for sliding receipt about said vertical post, and said tubular collar being structured and disposed to permit sliding, adjusted movement of said first brace arm throughout said range of fixed, vertically adjusted positions.

5. A scaffold apparatus comprising:

at least one frame unit including a base frame structure and an upper frame structure removably attachable to said base frame structure;

said base frame structure including:

at least one horizontal frame member having opposite ends;

a plurality of leg members extending downwardly and outwardly from said at least one horizontal frame member and each of said plurality of leg members including a bottom distal end structured and disposed for engagement with an underlying ground surface; said upper frame member including:

a vertical post attachable to said base frame structure:

a first brace arm movably received and supported on said vertical post and extending perpendicularly thereto, said first brace arm being selectively movable relative to said vertical post throughout a range of fixed vertically adjusted positions; and a second brace arm movably supported on said vertical post and said second brace arm including a horizontal portion extending generally perpendicular to said vertical post and above and opposite to said first brace arm, and a vertical extension member formed generally perpendicular and integral with said horizontal portion, and said vertical extension member, including a lower end zone;

said lower end zone of said vertical extension member and said first brace arm being structured and disposed for removable and supported attachment of said lower end zone of said vertical extension member to said first brace arm, to thereby support said vertical extension member in generally parallel, vertically extending relation to said vertical post of said upper frame structure, and said second brace arm being movable with said first brace arm throughout said range of fixed, vertically adjusted positions; and said first brace arm being structured and disposed for supporting a horizontally extending staging plank, and said horizontal portion of said second brace arm being structured and disposed for supporting a horizontally extending plank at a fixed height above said staging plank.

6. The scaffold apparatus as recited in claim 5 wherein said plurality of leg members each include an upper fixed section and a lower extendable section, said lower extendable section of each of said plurality of leg members terminating at said bottom distal end and said lower extendable section being adjustably extendable and retractable relative to said upper section throughout a range of adjusted positions to selectively vary the length of said leg member.

7. The scaffold apparatus as recited in claim 6 wherein said plurality of leg members include a first pair of said leg members extending downwardly and outwardly from a first one of said opposite ends of said at least one horizontal frame member and a second pair of said leg members extending downwardly and outwardly from a second one of said opposite ends of said at least one horizontal frame member, and thereby defining a saw horse configuration.

8. The scaffold apparatus as recited in claim 7 wherein said bottom distal ends of said plurality of leg members have pivoting feet structured and disposed for engagement with an underlying ground surface, and said pivoting feed being movable to accommodate for variations in the angle and contour of the underlying ground surface to thereby provide a stabilized seated engagement therewith.

9. The scaffold apparatus as recited in claim 5 wherein said first brace arm includes a tubular collar sized, structured and configured for sliding receipt about said vertical post, and said tubular collar being structured and disposed to permit sliding, adjusted movement of said first brace arm throughout said range of fixed, vertically adjusted positions.

* * * * *